United States Patent [19]

Sutton et al.

[11] Patent Number: 4,961,661

[45] Date of Patent: Oct. 9, 1990

[54] EXTENDABLE FLUID APPLICATOR

[76] Inventors: Terry J. Sutton; Debra S. Sutton, both of 1349 Meadow Creek Cir., #186, Irving, Tex. 75038

[21] Appl. No.: 904,347

[22] Filed: Sep. 5, 1986

[51] Int. Cl.[5] ..... A45D 34/00; A47L 13/16

[52] U.S. Cl. ..... 401/6; 401/140; 401/183; 401/184; 401/186; 401/205; 401/207

[58] Field of Search ..... 401/183, 184, 186, 6, 401/140, 205, 207

[56] References Cited

U.S. PATENT DOCUMENTS

| | | | |
|---|---|---|---|
| Re. 29,639 | 5/1978 | Dearling | 222/174 |
| 368,517 | 8/1887 | Cornwall . | |
| 571,456 | 11/1896 | Reeves . | |
| 1,170,923 | 2/1916 | Malkin | 401/183 |
| 1,319,023 | 10/1919 | Varvitsiotis | 401/183 X |
| 2,641,012 | 6/1953 | Storrs | 15/144 |
| 2,820,234 | 1/1958 | Rigney | 401/186 |
| 3,029,455 | 4/1962 | Siculan | 15/159 |
| 3,896,822 | 7/1975 | Zimmerman | 401/186 X |
| 4,150,904 | 4/1979 | Stewart | 401/186 |
| 4,299,005 | 11/1981 | Brown | 401/6 X |
| 4,329,755 | 5/1982 | Alissandratos | 15/144 B |
| 4,376,397 | 3/1983 | Newby et al. | 81/177 A |
| 4,415,288 | 11/1983 | Gordon et al. | 401/132 |
| 4,483,356 | 11/1984 | Kales | 401/6 X |
| 4,483,636 | 11/1984 | Meyer | 401/6 X |
| 4,524,484 | 6/1985 | Graham | 16/115 |

*Primary Examiner*—Steven A. Bratlie

*Attorney, Agent, or Firm*—Richards, Medlock & Andrews

[57] ABSTRACT

The present invention contemplates a fluid applicator useful for applying a fluid in a uniform and discrete manner to a remote surface wherein said applicator has a fibrous pad which is saturated and retains the fluid until applied to a surface, a valve or throttle means to control the amount of fluid in the fibrous pad and a telescoping handle element which can be extended to provide an elongate handle for reaching remote areas and to expose a cylindrical fluid vessel having a flexible wall which is compressed to extrude fluid therefrom and into the fibrous pad.

4 Claims, 1 Drawing Sheet

EXTENDABLE FLUID APPLICATOR

TECHNICAL FIELD

The present invention relates to a fluid dispensing apparatus having an extendable handle to allow fluid to be dispensed to a remote surface.

BACKGROUND ART

It is well known in the prior art to connect a brush structure containing bristles to an extendable handle. Typically, such brushes may be used for cleaning or scrubbing a surface which would be too remote or difficult to reach if the brush was merely held in the user's hand. For instance, U.S. Pat. No. 4,329,755 to Alissandratos discloses a brush having a molded head including bristles and a handle holder, wherein the handle is made of two pieces, one of which slips into the other for securing the handle in a retracted or extended position. Similarly, it is well known to place an extendable telescoping handle on a broom, as disclosed in U.S. Pat. No. 3,029,455 issued to Siculan.

Likewise, the prior art contemplates a brush or sponge assembly being mounted on an extendable handle for the purpose of applying a cleaning liquid and the brush's scrubbing action to a remote location. An example of a sponge assembly mounted on a telescoping handle is disclosed in U.S. Pat. No. 4,524,484 issued to Graham, wherein a window washing sponge is mounted on an extendable handle and is saturated with a cleaning solution by being submerged in the solution located at a remote source to allow the sponge to absorb the same.

Further, the prior art also contemplates liquid dispensing brushes or sponges mounted on extendable handles having self-contained fluid reservoirs. For example, U.S. Pat. No. 2,641,012 issued to Storrs discloses a bathing scrub brush having soap reservoirs fluidly connected to external bristles to dispense soap during brushing action, and having an extendable handle so that the brush may be applied to the human body to remote locations, such as the back. This type of prior art brush suffers the disadvantage of being unable to dispense its selfcontained fluid in a controlled and uniform manner, and has no regulating means to prohibit the flow of fluid when the instrument is not in use.

The prior art also contemplates a sponge device having an nonextendable handle and a fluid reservoir fluidly connected to the sponge to assure constant saturation of the sponge by the fluid. An example of this type of device is disclosed in U.S. Pat. No. 4,415,288 to Gordon, et al., which teaches a hospital surgical scrub having a fluid cartridge located in the scrub's handle which is ruptured by insertion into the handle to a predetermined degree, and has means to allow passage of the cartridge's fluid into a sponge to allow a semicontrolled and uniform application of the fluid by contacting the sponge with a body surface. These types of devices also suffer the disadvantage of having no means to regulate the flow of fluid into the dispensing sponge.

The prior art further contemplates an aerosol spray device wherein the fluid to be applied to a surface is contained in the device's handle and is to applied to a surface by a pumping action applied to the handle. Examples of these types of devices are disclosed in U.S. Pat. Re. 29,639 issued to Dearling. While these types of devices contemplate the use of a control means to regulate the flow of the self-contained fluid, they suffer the disadvantage of being unable to deliver predetermined amounts of the fluid in a uniform pattern over a surface.

Consequently, a need exists in the art for a means to apply a fluid on a surface in a regulated and uniform pattern by direct application without the use of an aerosol spray or heavy bristle. A further need exists for a fluid applicator having a selfcontained fluid reservoir from which fluid can pass in a predetermined amount and which has a means to throttle or prohibit fluid flow. Yet a further need exists in the art for a fluid applicator having an extendable handle to reach remote areas of the human body allowing an application of a uniform predetermined amount of fluid. Yet a further need exists for a fluid applicator having a means to direct fluid flow from the applicator to a discrete predetermined location.

SUMMARY OF THE INVENTION

The present invention contemplates an extendable fluid applicator having a fluid reservoir with flexible sides to allow the user to extrude a predetermined and discrete amount of fluid therefrom by simple deformation of the vessel's sides and contemplates a tube or sleeve slidably mounted about said vessel and extendable to an elongate position to serve as a handle to permit application of a fluid to a remote location. Further, the present invention contemplates a tube or sleeve positioned about the length of a fluid containing vessel and sufficiently rigid to prohibit deformation of the vessel's sides, prohibiting extrusion of fluid therefrom. The present invention also contemplates an elongate cutout located in the tube to permit deformation of the vessel's sides when the tube is positioned about the length of the vessel.

In another aspect, the present invention contemplates a neck assembly mounted on a fluid containing vessel to permit application of a fluid to a remote location that would be difficult or impossible for the user to reach by hand.

In yet another aspect of the present invention, a valve or throttle means is located within the neck assembly to prohibit or regulate the flow of fluid from the vessel. Further, the present invention contemplates a fibrous pad mounted on the neck assembly and fluidly connected thereto to permit fluid to be dispensed from a sponge-like surface. In particular, the present invention contemplates a fibrous pad of sufficient porosity to allow saturation thereof by a fluid passing from the neck assembly, but simultaneously prohibiting any fluid from dripping or oozing therefrom until the fibrous pad is contacted with a surface. In yet another aspect, the present invention contemplates the fibrous pad being swivelly mounted on the neck assembly so as to permit the pad to contact a large surface area regardless of the disposition of the neck assembly and handle with respect to the surface.

The present invention is particularly useful for applying suntan lotion in a predetermined and uniform amount to a user's back, which area is inaccessible by mere hand application of lotion. The present invention also contemplates an apparatus which is useful for applying any body lotion, shampoo, or antiseptic to the human body or an animal's body, for example, and is useful for applying paint, mucilage, chemical reagents, or toxic substances, for example, to any surface. In general, the present invention is particularly useful for applying any fluid in a controlled manner to a remote surface.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION

Figure 1:
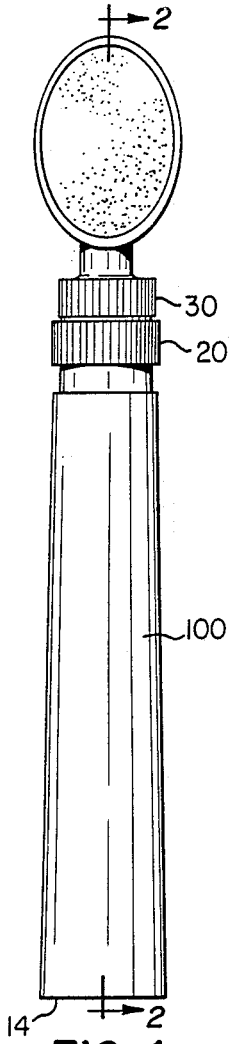
FIG. 1 is a front view of the apparatus of the present invention.
Figure 2:
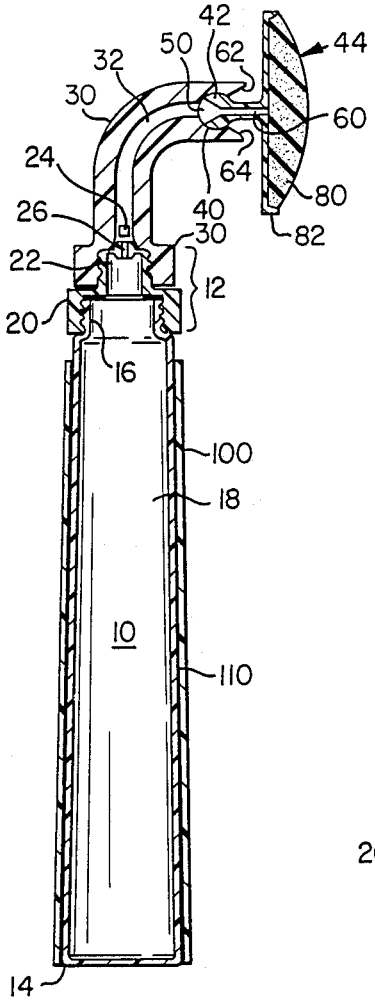
FIG. 2 is a sectional view of the present invention taken along lines 2—2 in FIG. 1.

Referring initially to FIGS. 1 and 2, the apparatus of the present invention includes a cylindrical vessel 10 having ends 12 and 14, with a threaded section 16 located at end 12. Threaded section 16 engages with a screw on cap 20 which includes threaded section 22. A neck assembly 30 is threaded onto threaded section 22 and has plug 24 located to close an orifice 26 in threaded section 22 when neck assembly 30 is in its lower position.

In particular, as seen in FIG. 2, neck assembly 30 may be rotated so that plug 24 is removed from orifice 26 to allow passage of fluid into passageway 32 located in neck assembly 30. Likewise, neck assembly 30 may be rotated in the opposite direction so that plug 24 seats in orifice 26 to prohibit passage of fluid from the interior 18 of vessel 10 into passageway 32 located in neck assembly 30. It will be understood that in an alternative embodiment plug 24 may be a "pop up" valve, wherein threaded section 22 is eliminated and neck assembly 30 is slidably engaged with screw on cap 20 and has first and second positions, wherein the first position causes plug 24 to be seated in orifice 26 and in the second position plug 24 is removed from orifice 26 to allow fluid to pass therethrough. It will be further understood that various other valves or fluid flow regulating means may be employed in alternative embodiments of the present invention.

Located at the end of neck assembly 30, most distant from threaded section 22 of cap 20, is a socket 40 sized to rotatably engage with a barrel 42. Barrel 42 has a fibrous pad assembly 44 attached thereto. Socket 40 has barrel 42 engaged therewith, barrel 42 having passage 50 through its center to fluidly connect passage 32 in neck assembly 30 with fluid passage 60 in pad assembly 44. It will be understood that in an alternate embodiment barrel 42 can be a ball to allow greater freedom of movement of the neck assembly. Passage 50 is generally of conical shape to assure that passages 32 and 60 remain fluidly connected regardless of the angular disposition of pad assembly 44. Pad assembly 44 is connected to barrel 42 by a stem 46 and the rotational movement of pad assembly 44 is limited by stem 46's engagement with walls 62 and 64 located in neck 30 proximate to socket 40.

It will be understood that pad assembly 44 comprises a fibrous material 80 mounted on a rigid support platform 82, wherein fibrous material 80 is sufficiently porous to permit saturation thereof by a fluid, but prohibits dripping or oozing of the fluid therefrom. Fibrous material 80 is made from a material suitable to allow the deposit of any fluid located therein onto a surface upon contact with the surface.

Figure 4:
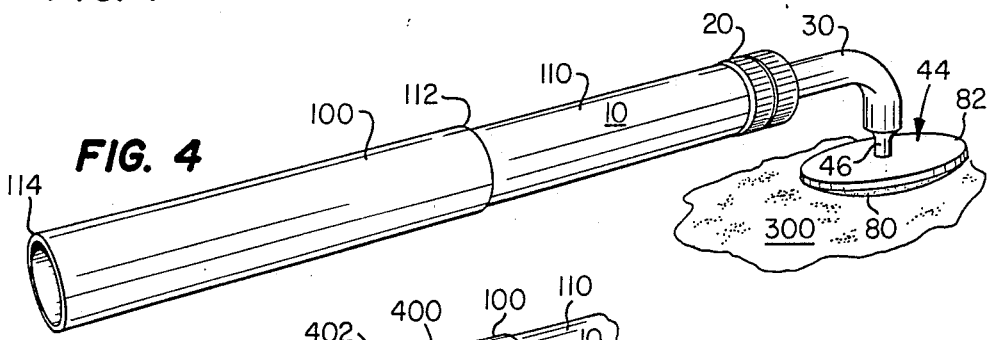
FIG. 4 is a perspective view of the apparatus of the present invention.

Tubular sleeve 100 mounted on the exterior surface of tubular vessel 10, having an internal diameter sufficiently greater than the outer diameter of tubular vessel 10 to permit the sleeve to slide thereon. It will be further understood that tubular vessel 10 is of substantially circular cross section and tapered such that its outer diameter at end 14 may be larger than its outer diameter at end 12; and similarly tubular sleeve 100 is of substantially circular cross section and tapered such that its inner diameter at end 114 is larger than its inner diameter at end 112. It will be further understood that the internal diameter of the end 112 of tubular sleeve 100 is smaller than the outer diameter of end 14 of tubular vessel 10 so that tubular sleeve 100 is prohibited from being removed from tubular vessel 10 at end 14, and becomes securely frictionally engaged with tubular vessel 10 at a predetermined position when removal is attempted. The frictional engagement of end 14 of tubular vessel 10 and end 112 of tubular sleeve 100 serves to secure the tubular sleeve 100 and the tubular vessel 10 in an extended position, as shown in FIG. 4. With the tubular sleeve 100 and the tubular vessel 10 in said extended position, the tubular sleeve 100 functions as an extendable handle whereby a user can apply fluid to remote locations. As seen in FIGS. 1 and 2, cap 20 is of sufficient diameter so as to prohibit passage of end 112 of tubular sleeve 100 to a point beyond cap 20, thus limiting the movement of tubular sleeve 100 between its first position, as shown in FIG. 1, and the second position (as shown in FIG. 4).

Figure 3:
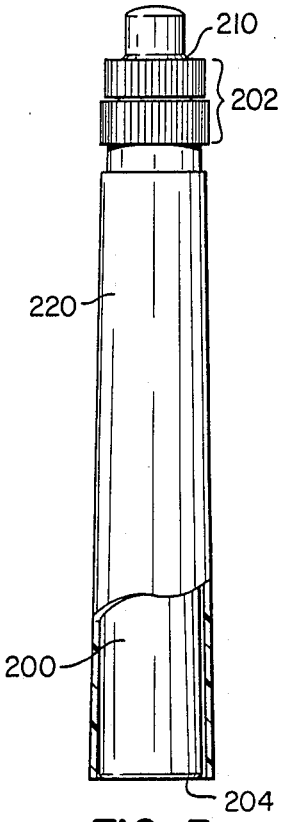
FIG. 3 is a side view of an alternative embodiment of the present invention.

Referring now to FIG. 3, an alternative embodiment of the present invention is shown wherein tubular vessel 200 has first and second ends 202 and 204, respectively, and has a valve assembly 210 engaged at its first end 202. Valve assembly 210 has an orifice (not shown) which permits application of the contents of tubular vessel 200 directly onto a surface from valve assembly 210. This alternative embodiment also contemplates a tubular sleeve 220 slidably mounted about the elongate axis of tubular vessel 200, which can be located in two positions as described above.

Referring now to FIG. 4, the preferred embodiment of the present invention is shown having tubular sleeve 100 in its fully extended position with tubular vessel 10's flexible wall 110 exposed to permit the vessel to be squeezed to cause fluid to pass into fibrous pad assembly 44. It will be understood that wall 110 is significantly flexible and elastic to allow the volume of the vessel to be decreased by the application of an external force to the wall, and is biased to return to a position of substantially circular cross section when the force is removed. It will be further understood that tubular sleeve 100 is of sufficient strength to prohibit deformation of flexible wall 110 when the sleeve is in its first position covering the wall. This aspect of the present invention serves to prohibit discharge of the fluid contents of tubular vessel 10 unless tubular sleeve 100 is in its second position. The fluid contents of tubular vessel 10 is applied to the surface in the form of smear 300.

Figure 5:
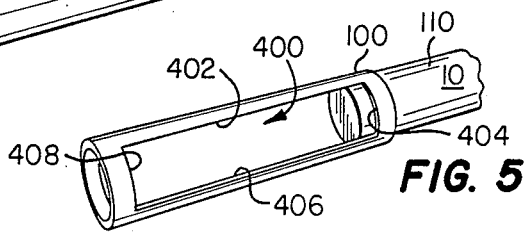
FIG. 5 is a partial perspective view of the apparatus of the present invention.

Referring now to FIG. 5, in an alternative embodiment tubular sleeve 100 is shown in its second position and has elongate cutout 400. Cutout 400 facilitates the user's grip on tubular sleeve 100, and may be employed with a second elongate cutout located at the opposite side of the tubular sleeve (not shown). Most importantly, when tubular sleeve 100 is in its first position cutout 400 allows the user to deform flexible wall 110 to extrude the contents of tubular vessel 10. The presence of cutout 400 in tubular sleeve 100 is preferred when it is necessary or desirable to extrude the contents of vessel 10 when the sleeve is in its first position as shown in FIGS. 1 and 2.

In operation, the user extends tubular sleeve 100 to expose flexible wall 110 of the tubular vessel 10, and rotates the neck assembly 30 so that the valve is in its open position to allow fluid to pass from the tubular vessel through the neck assembly and saturate fibrous material 80. The user deforms tubular vessel 10 by hand to cause the internal volume thereof to decrease and extrude a fluid contained therein through passageway 32 located in neck assembly 30. Sufficient force is applied by the user to assure that fluid passes through passage 50 in barrel 42 and fluid passage 60 in fibrous pad assembly 44 to reach fibrous material 80. When the user is satisfied that fibrous material 80 is saturated with fluid, the user then grips tubular sleeve 100 and can apply the fluid in a predetermined amount in a uniform manner to a remote surface, such as the human back. It will be understood that there is no need for the user to continue to deform the cylindrical vessel to facilitate application of the fluid, but that the fibrous material 80 is of sufficient volume to permit an adequate application thereof to the desired surface. It will be understood that the present invention provides the advantage of permitting the user to apply the fluid with one hand, eliminating the previously necessary step of pumping the apparatus to apply fluid therefrom.

Although preferred and alternative embodiments of the invention have been described in the foregoing Detailed Description and illustrated in the accompanying Drawings it will be understood that the invention is not limited to the embodiments disclosed, but is capable of numerous rearrangements, modifications, and substitution of parts and elements without departing from the spirit of the invention. The present invention is therefore intended to encompass such rearrangements, modifications and substitution of parts and elements as fall within the scope of the invention.

We claim:

1. A fluid applicator comprising a tubular vessel having first and second ends, an elongate axis and a wall extending between said first and second ends, wherein said first end further comprises a port through which a fluid may pass from the interior of said tubular vessel;

said wall having a smooth exterior surface sufficiently flexible to allow the volume of said tubular vessel to be decreased by the application of an external force to said wall to cause the fluid located in said tubular vessel to be extruded through said port, and said wall being biased to return to a position having a substantially circular cross section when said force is removed;

further comprising a tubular sleeve having an elongate axis and first and second ends, which axis is substantially concentric with the elongate axis of said tubular vessel, wherein the inner diameter of said tubular sleeve is sized to slidably engage with the outer diameter of said wall of said tubular vessel and said tubular sleeve is mounted about said tubular vessel in a first position, wherein said tubular sleeve's first end is proximate said tubular vessel's first end and said tubular sleeve's second end is proximate said tubular vessel's second end, and has a second position wherein said tubular sleeve's first end is proximate said tubular vessel's second end and said tubular sleeve's second end is extended from said tubular vessel's second end; and the tubular vessel being tapered with the diameter of the tubular vessel larger at its second end than at its first end, and the tubular sleeve being tapered with the diameter of the tubular sleeve larger at its second end than at its first end, with the exterior diameter of the second end of said tubular vessel larger than the internal diameter of the first end of the tubular sleeve so that the first end of the tubular sleeve is prohibited from passing over the second end of the tubular vessel to avoid disengagement of the tubular sleeve from the tubular vessel, and so that the tubular sleeve can be frictionally wedged against the tubular vessel with the first end of the tubular sleeve proximate the second end of the tubular vessel to secure the said tubular sleeve in an extended position.

2. The fluid applicator of claim 1 wherein said tubular sleeve is sufficiently rigid to prohibit said tubular vessel's flexible wall from being deformed when said tubular sleeve is in its first position.

3. The fluid applicator of claim 1 wherein said tubular sleeve has an elongate cutout to allow access to said tubular vessel's flexible wall when said tubular sleeve is in its first position, permitting said tubular vessel's flexible wall to be deformed by the application of pressure thereto through said elongate cutout.

4. The fluid applicator of claim 1 wherein said tubular vessel has a cap assembly attached to its first end, wherein said tubular vessel and cap assembly are sized so as to prohibit the passage of said tubular sleeve from its first position to a position where said tubular sleeve's first end is located over said cap.

* * * * *